United States Patent [19]

Clark et al.

[11] 4,264,062

[45] Apr. 28, 1981

[54] APPARATUS FOR MELTING AND FEEDING METAL AT A CONTROLLED RATE AND TEMPERATURE

[75] Inventors: I. Dwight Clark, New Hartford, N.Y.; Falih N. Darmara, Southbury, Conn.

[73] Assignee: Special Metals Corporation, New Hartford, N.Y.

[21] Appl. No.: 101,956

[22] Filed: Dec. 10, 1979

[51] Int. Cl.[3] ..... H05B 6/18

[52] U.S. Cl. ..... 266/200; 13/27; 75/10 R

[58] Field of Search ..... 13/27; 266/200; 75/10 R

[56] References Cited

U.S. PATENT DOCUMENTS

| | | | |
|---|---|---|---|
| 2,091,087 | 8/1937 | Wempe | 13/27 |
| 2,122,241 | 6/1938 | Arnold | 13/27 |
| 3,273,212 | 9/1966 | Garmy et al. | 75/10 R |

*Primary Examiner*—M. J. Andrews

*Attorney, Agent, or Firm*—Vincent G. Gioia; William J. O'Rourke, Jr.

[57] ABSTRACT

An apparatus for feeding molten metal at a substantially constant rate of at least 3 pounds per minute is disclosed. This apparatus includes a receptacle for holding a maximum volume of molten metal therein, a heater to maintain the metal in a molten state, and an overflow runner through which molten metal flows from the receptacle as the amount of molten metal exceeds the maximum volume of the receptacle. The apparatus further includes a system for advancing a solid charge of metal toward the molten metal holding portion of the receptacle and a control for the advancing system to insure that the melting rate of the solid charge that is advanced toward the receptacle is substantially constant. In the operation of this apparatus the receptacle is filled with molten metal at its maximum volume and subsequent control of the melt rate of the solid charge by controlled advancement thereof results in a substantially constant molten metal feed rate through the overflow runner.

10 Claims, 1 Drawing Figure

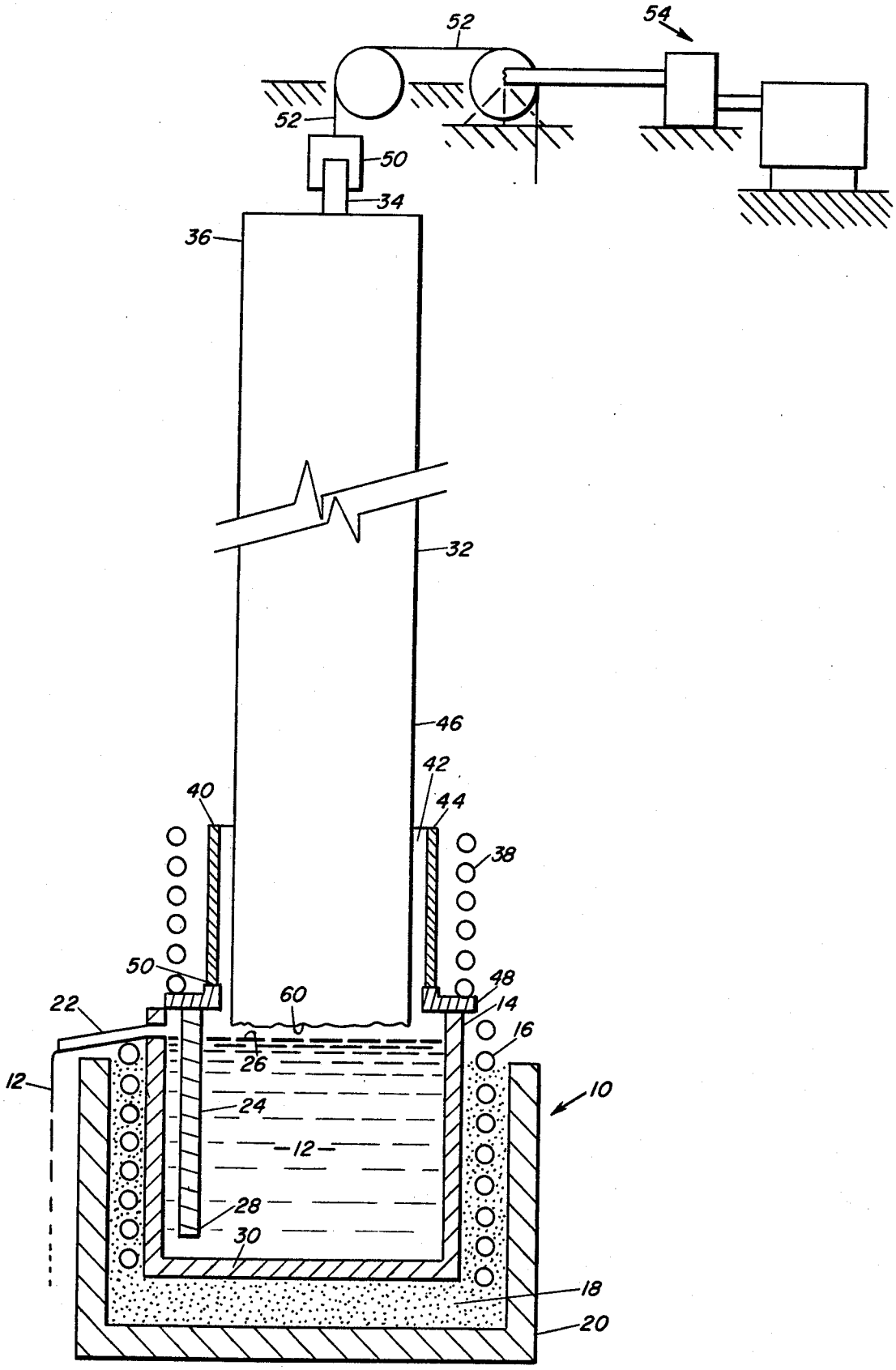
52
54
52
50
34
36
32
46
42
40
44
38
50
48
22
60
14
16
26
12
10
24
12
28
30
18
20

APPARATUS FOR MELTING AND FEEDING METAL AT A CONTROLLED RATE AND TEMPERATURE

BRIEF SUMMARY OF THE INVENTION

The present invention is related to an apparatus for melting metal, and more particularly to an improved apparatus for melting a solid charge of metal and feeding the melted metal at a substantially constant rate of at least 3 pounds per minute while maintaining a substantially controlled metal temperature.

The prior art such as U.S. Pat. No. 3,920,062 teaches that a tundish may be effectively utilized to control molten metal feed rates. It is well known however, that a tundish adds a rather complex and somewhat costly apparatus to a metal melting and feeding system. It is also known that certain metallurgical processes are more efficiently controlled if a substantially constant feed rate can be maintained. For certain processes and desired metal feed rates are so low that they cannot always be accurately controlled even with a tundish. Such processes include rotary disk powder production, drip casting of ingots having relatively small cross-sectional dimensions, and certain continuous casting or precision casting operations.

An alternative method of accomplishing a low, consistent melt rate is disclosed in U.S. Pat. No. 3,887,667. This method pertains to the vacuum arc melting of prealloyed consummable electrodes by passing a current through the appropriate electrical connections in order to strike an arc and melt the electrodes. The melt rates in electrical arc melting processes are dependent upon, inter alia, the stability of the current, the eletroded spacing, and the controlled atmosphere in which the melting takes place. It has been found that such low melt rates tend to fluctuate because of the difficulties incurred in controlling these variables. These fluctuations may not affect some melting processes, but for other processes increased melt rate control results in increased quality of the product. It is therefore desirable for some processes to control low melting and feeding rates to within close tolerances.

Recognizing the difficulties associated with melt rate control, those skilled in the art have sought alternative methods of producing successful products by, for example, drip casting. In U.S. Patent Application No. 038,967, filed May 14, 1979, the inventors have found that fine grain castings of improved quality may be produced by electric arc melting with a drip casting arrangement that insures that the molten metal falling from the consumed electrode falls directly into an open ended mold. By such arrangement, however, the metal cannot be subjected to superheating which in certain other applications may be preferred in order to remove carbides from the metal, for instance.

Also, in U.S. Pat. No. 3,847,205 an apparatus for continuously casting which employs a device for controlling the metal height in a continuous casting mold is disclosed. Recognizing that the metal feed rates are not consistent, such control device operates by alternating the speed at which the casting is withdrawn from the mold. By such an arrangement the castings may be produced which are characterized by a variety of castings rates.

Accordingly, an apparatus for melting a solid charge is desired in which a constant molten metal feed rate, greater than 3 pounds per minute, may be accurately maintained.

The present invention may be summarized as providing an improved apparatus for feeding molten metal at a substantially constant rate of at least 3 pounds per minute. This apparatus includes a receptical for holding a maximum volume of molten metal, a heater for maintaining the molten metal at a substantially constant temperture and an over-flow runner through which the molten metal flows from the receptical as the amount of molten metal exceeds the maximum volume of the receptical. This apparatus further includes a system for advancing a solid charge of metal toward the molten metal portion of the receptical, and a control for the advancing system to insure that the melting rate of the solid charge that is advanced toward the receptical is substantially constant. By the operation of this apparatus the receptical is filled with molten metal at its maximum volume and subsequent controlled melting of the solid charge by controlled advancement thereof, results in a substantially constant molten metal feed rate through the over-flow runner.

Among the advantages of the present invention is the provision of an apparatus in which the melting rate of the solid charge, the feeding rate of the molten metal, and the temperature of the molten metal may be controlled to within close tolerances.

Another advantage of the apparatus of the present invention is that metal feed rates may be held constant independently of the metal pouring temperature. Alternatively, the metal pouring temperature may be held constant independently of the controlled metal feed rate. The ability to effectuate such control of the feed rate and temperature makes continuous casting in vacuum and other processes possible.

A further advantage of the apparatus of the present invention is that the molten metal temperature may be controlled, and the molten metal may be superheated without interruptions of the melting or feeding operations.

A primary objective of the present invention is to provide an apparatus in which relatively low metal feed rates may be maintained.

Another objective of this invention is to provide an apparatus in which the metal melting and feeding rates are controlled substantially independently of the operating characteristics of an induction heated furnace into which the metal may be melted.

The above and other objectives and advantages of this invention will be more fully understood and appreciated with reference to the following detailed description and the drawings appended hereto.

BRIEF DESCRIPTION OF THE DRAWINGS

The sole FIGURE of this application is a schematic view of an embodiment of the apparatus of the present invention for melting and feeding metal at a controlled rate and temperature.

DETAILED DESCRIPTION

As explained in detail below, the present invention is directed to an apparatus for feeding molten metal at a substantially constant low feed rate. As used herein "low feed rates" are those which do exceed 3 pounds per minute. Low feed rated of the present invention may be as high as approximately 250 pounds per minute, however, in a preferred embodiment the feed rates of the present invention are within the range of from about 3 to 50 pounds per minute.

The apparatus of the invention includes a receptical 10 for holding a maximum volume of molten metal 12 therein. As shown in the drawing the receptical 10 which is preferably of cylindrical configuration may include a refractory crucible 14, or receptical, for containing the molten metal 12 therein. The crucible 14 may be constructed of aluminum oxide, or similar material which is capable or retaining without contaminating the molten metal 12 therein. A heater 16 should be provided around the refractory crucible 14. Preferably, an induction coil 16 is provided around the outer periphery of the crucible. By controlling the power supplied to such an induction coil 16 the temperature of the molten metal 12 in the crucible 14 can be controlled to within tight tolerances independent of the melting and feeding rates as discussed in more detail below. The induction coil 16 is supported in its position about the crucible 14 preferably through the use of a rammed refractory 18.

To protect the crucible 14 and the induction coil 16 and to provide a structural support for this assembly, a frame 20 preferably of metallic construction may be provided around the induction coil 16. It will be understood by those skilled in the art that such frame may also act to support the rammed refractory 18 which holds the induction coil 16 in place.

Extending outwardly of the crucible 14 at a location at or near an upper portion of the crucible 14 is an overflow runner 22. The runner 22 may also be constructed of a refractory material, such as aluminum oxide, which resists metal attack and does not contaminate the metal passing therethrough. It will be understood that the location of the overflow runner 22 as it intersects the crucible 14 wall determines the maximum volume of molten metal 12 that is retained within the crucible 14. Logically, if the amount of molten metal 12 exceeds such maximum volume the molten metal 12 flows from the crucible 14 through the runner 22. To assist the flow of metal from the crucible 14 to the runner 22 is preferably provided with a slight downward taper as it extends outwardly of the crucible 14 as illustrated in the drawing.

In a preferred embodiment the crucible 14 is provided with a baffle 24 which provides a barrier at the upper surface 26 of the molten metal 12 in the crucible 14 at a location near the runner 22. Such baffle 24 prevents slag, skim or other impurities which accumulate at or near the molten metal surface 26 from flowing through the runner 22. A bottom portion 28 of the baffle 24 should be spaced from the bottom 30 of the crucible 14 to permit the flow of molten metal through such space. It will be understood that a series of baffles (not shown) may be provided to create desirable flow patterns or to entrap additional slag or other impurities prior to discharge of the molten metal 12 through the runner 22 as may be desired in certain instances.

In the operation of the apparatus of the present invention a solid charge 32 of metal is advanced towards the molten metal 12 in the crucible 14. As shown in the drawing, the solid charge 32 may be cylindrical, although practically any type of solid charge which can be advanced into the crucible 14 may be employed. Preferably, the cross sectional dimensions of this solid charge 14 should be uniform throughout the length of the charge in order to insure that the solid charge 32 is melted at a substantially constant rate.

The preferred arrangement for the apparatus of the present invention is illustrated in the drawing. As shown, the cylindrical solid charge 32 is supported from a butt 34 located at a remote end 36 of the solid charge. The solid charge 32 may be advanced through a preheating device, such as the second induction coil 38, located immediately above the crucible 14. Such a preheating device 38 may be desirable to initiate and accelerate the heating of the solid charge 32 toward its melting point.

A guiding device 40 which also serves as a coil protector may be located inwardly of the second induction coil 38 with respect to the solid charge 32. This device 40 should have a cross sectional configuration matching, but slightly greater than, the cross sectional configuration of the solid charge 32. The device 40 may be constructed of a refractory material such as aluminum oxide. Also, a substantially air-tight seal should be maintained to close a gap 42 between the upper end of the guiding device 44 and the outside wall of the solid charge 46. Likewise, a seal 48 should be provided between the bottom portion 50 of the guiding device 40 and an upper portion of the crucible 14. Such seals should extend around the periphery of the apparatus, and substantially prevent air or other ambient atmosphere from entering into and adversely affecting the operation after heating of the solid charge 32 has been initiated.

The rate of advance of the solid charge 32 toward the molten metal 12 in the crucible 14 should be controllable to within tight tolerances. In a preferred embodiment, the butt 34 at the remote end 36 of the solid charge 32 may be attached by an appropriate coupling device 50 to a motor driven chain 52. It should be understood by those skilled in the art that a cable, rod, belt or the like may be employed in place of the chain 52. The chain 52 should be accurately responsive to incremental movements of a motorized drive system 54. Such drive system may be electrically operated, pneumatically driven, or driven by a rack and pinion or ratchet type device as may be desired. If necessary, the chain 52 may be threaded through gears, drives, or sprockets to effect speed reductions which may be necessary in the operation of the apparatus of the present invention. Regardless of the advancing system employed, such system must be responsive to signals or commands indicative of the melting rates and, therefore, must be able to be controlled in relationship to the melting rate during the operation of the apparatus. It will be understood that the amount of metal 12 discharged from the overflow runner 22 is indicative of the melting rate.

In the operation of the apparatus of the present invention the crucible 14 is provided with molten metal 12. Either molten metal 12 may be poured directly into the crucible 14 or a solid charge may be melted therein by the heat of the first induction coil 16. The molten metal 12 in the crucible 14 is preferably superheated to a predetermined temperature. Such superheated temperature should be chosen with consideration of the temperature loss that will typically occur in the system, particularly the temperature loss experienced by the discharged metal from the point of discharge to the point of entry into the system being fed, whatever and wherever such system may be. Such superheat temperature should also be chosen with consideration of the melting rate of the solid charge 32 and the dissolution effect that the colder melted charge may have on the balance of the molten metal 12 in the crucible 14.

With the molten metal 12 maintained at a substantially constant superheated temperature, a solid charge 32, preferably a cylindrical billet, is lowered through a preheating device 38 toward the upper surface 26 of the molten metal 12 in the crucible 14. The preheater 38 preferably raises the temperature of the solid charge 32 from ambient or room temperature at the entry end of the preheater to within about 75%, or higher, of the melting temperature at the exit end of the preheater 38.

As the solid charge 32 is moved further toward the molten metal 12 in the crucible 14, and the lower face 60 of the solid charge 32 approaches the upper surface 26 of the superheated molten metal 12 melting of the solid charge 32 commences. It will be understood by those skilled in the art that, if any, molten metal 12—solid charge 32 contact may occur during melting. The preheating system 38 raises the temperature of the charge 32 to a point which facilitates melting as the charge is exposed to the ambient superheat temperature above the level 26 of the molten metal 12 in the crucible 14. And, contact, even slight contact with the molten metal surface, facilitates smooth and effecient melting of the solid charge.

As the solid charge 32 melts into the crucible 14 the amount of molten metal 12 in the crucible 14 exceeds the maximum volume determined by the location of the overflow runner 22. Therefore, as the maximum volume is exceeded, molten metal 12 flows from the crucible 14 through the overflow runner 22. By constantly controlling the melting rate, the feed rate through the overflow runner 22 may also be controlled. Therefore, it is necessary to maintain all of the variables in the apparatus of the present invention as constant as possible in order to control the molten metal feeding at a substantially constant, low rate. For example, by maintaining the preheat induction coil 38 and the superheat induction coil 16 at a constant temperature, and lowering the solid charge 32 at a constant rate the molten metal feed rate will be held substantially constant. However, in order to accommodate certain fluctuations in the system and to provide for a very tight control of the feed rate a device for measuring the feed rate may also be provided. Such device should generate a feed rate signal, and the advancing mechanism should be directly responsive to such feed rate signal. Thus, if a low molten metal feed rate such as 7 pounds per minute is desired and the feed rate signal indicates an actual rate of 6.5 pounds per minute, the advancing mechanism would speed the rate of advance of the solid charge 32, slightly, in order to compensate for the reduced feed rate and to bring the actual feed rate to the desired level.

As mentioned above such low, constant heat rates may be used to feed a variety of metal production facilities. Preferred systems which require low, constant feed rates include powder atomization systems, continuous casting systems and drip casting systems, and by the process of the present invention such systems may be operated in vacuum.

What is believed to be the best mode of this invention has been described above. It will be apparent to those skilled in the art that numerous variations of the illustrated details may be made without departing from this invention. For example, a plurality of solid charges may be simultaneously or successively advanced toward a crucible. Such a multiple solid charge system may be employed to insure the maintenance of a continuous system which permits melting and feeding to be maintained while one of the nearly melted solid charges is being replaced with a new charge. Also, a plurality of overflow runners may be employed in the apparatus of the present invention in order to feed a plurality of metal producing systems.

What is claimed is:

1. An apparatus for feeding molten metal at a substantially constant rate and at a substantially constant temperature, said rate being in a range of from 3 to 50 pounds per minute, said apparatus comprising:

a crucible for holding a maximum volume of molten metal therein, an induction coil for heating the molten metal in the crucible to maintain the molten metal therein at a substantially constant temperature in excess of 2500° F., an overthrough runner through which molten metal flows from the crucible as the amount of molten metal exceeds the maximum volume of the crucible, a motorized drive system connected to one end of a solid charge of metal having substantially uniform cross-sectional dimensions, for advancing said solid charge of metal toward the molten metal holding portion of the crucible, a second induction coil adjacent the crucible through which the solid charge of metal is preheated to at least 75% of the melting temperature of the solid charge during advancement toward the crucible, a maximum volume of molten metal in the crucible maintained at a temperature in excess of 2500° F. to melt the solid charge of metal as it advances toward the crucible such that the melted portion thereof flows directly from the solid charge into the crucible, means for measuring the molten metal feed rate through the overflow runner, said motorized drive system directly responsive to said measuring means such that the rate of advance of the solid charge of metal toward the crucible is reduced if the actual molten metal feed rate exceeds the desired molten metal feed rate and the rate of advance of the solid charge of metal toward the crucible is accelerated if the actual molten metal feed rate is less than the desired molten metal feed rate, and at least one baffle located in the receptacle and adjacent the overflow runner, and disposed substantially perpendicular to an upper surface of the molten metal in the receptacle, with a top portion of said baffle located above said molten metal surface, and a bottom surface and spaced from a bottom portion of the receptacle.

2. An apparatus for feeding molten metal at a substantially constant rate, said rate being at least 3 pounds per minute, said apparatus comprising:

a receptacle for holding a maximum volume of molten metal therein, means for heating the molten metal in the receptacle to maintain the metal in a molten state, an overflow runner through which molten metal flows from the receptacle as the amount of molten metal therein exceeds the maximum volume of the receptacle, means for advancing a solid charge of metal toward the molten metal holding portion of the receptacle, means for melting the solid charge of metal such that the melted portion thereof flows directly from the solid charge into the molten metal holding portion of the receptacle, means for controlling the advancing means to insure that the melting rate of the solid charge is substantially constant, and at least one baffle located in the receptacle and adjacent the overflow runner, and disposed substantially perpendicular to an upper surface of the molten metal in the receptacle, with a top portion of said baffle located above said molten metal surface, and a bottom portion of said baffle located below said molten metal surface and spaced from a bottom portion of the receptacle.

3. An apparatus as set forth in claim 2 wherein the molten metal in the receptacle is maintained at a substantially constant temperature.

4. An apparatus as set forth in claim 2 wherein the solid charge has substantially uniform cross-sectional dimensions throughout a substantial length of said charge.

5. An apparatus as set forth in claim 2 further including a preheating device through which the solid charge passes prior to advancement into the receptacle.

6. An apparatus as set forth in claim 5 wherein the preheating device comprises an induction coil.

7. An apparatus as set forth in claim 5 wherein a substantially air-tight seal is provided between an exit end of the preheater and an entry end of the heating means.

8. An apparatus as set forth in claim 5 wherein the preheating device raises the temperature of the solid charge passing therethrough to at least 75% of the melting temperature of the solid charge.

9. An apparatus as set forth in claim 2 further including means for measuring the feed rate of the molten metal flowing through the overflow runner to generate a signal indicative of the molten metal rate.

10. An apparatus as set forth in claim 9 wherein the advancing means is directly responsive to the signal indicative of the molten metal melting rate.

* * * * *